US009877110B2

(12) United States Patent
Timmins

(10) Patent No.: US 9,877,110 B2
(45) Date of Patent: Jan. 23, 2018

(54) RIBBON SUPPORT SYSTEM FOR ELECTRODYNAMIC MICROPHONE

(71) Applicant: Michael Patrick Timmins, Seattle, WA (US)

(72) Inventor: Michael Patrick Timmins, Seattle, WA (US)

( * ) Notice: Subject to any disclaimer, the term of this patent is extended or adjusted under 35 U.S.C. 154(b) by 0 days.

(21) Appl. No.: 14/981,736

(22) Filed: Dec. 28, 2015

(65) Prior Publication Data

US 2016/0198265 A1 Jul. 7, 2016

Related U.S. Application Data

(60) Provisional application No. 62/097,272, filed on Dec. 29, 2014.

(51) Int. Cl.

| | |
|---|---|
| ***H04R 1/02*** | (2006.01) |
| ***H04R 9/04*** | (2006.01) |
| *H04R 1/22* | (2006.01) |
| *H04R 1/06* | (2006.01) |
| *H04R 9/02* | (2006.01) |

(Continued)

(52) U.S. Cl.

CPC ..... *H04R 9/048* (2013.01); *H04R 1/06* (2013.01); *H04R 1/222* (2013.01); *H04R 1/2876* (2013.01); *H04R 9/025* (2013.01); *H04R 9/08* (2013.01); *H04R 2207/00* (2013.01); *H04R 2307/023* (2013.01); *H04R 2400/07* (2013.01)

(58) Field of Classification Search

CPC .. H04R 1/2876; H04R 2400/07; H04R 9/048; H04R 1/06; H04R 2307/023; H04R 9/08; H04R 9/025; H04R 2207/00; H04R 1/222

See application file for complete search history.

(56) References Cited

U.S. PATENT DOCUMENTS 1,885,001 A 10/1932 Olson
2,141,420 A 12/1938 Swickard (Continued)

*Primary Examiner* — Muhammad N Edun

(74) *Attorney, Agent, or Firm* — Lambert Patent Services, LLC; Kal K Lambert

(57) ABSTRACT

A ribbon microphone having a housing made of wood, a wood laminate, or another suitable composite material having a characteristic impedance and density and a ribbon transducer assembly with metal support chassis having a higher characteristic impedance and density. By engineering a body housing and the ribbon support chassis having a similar or equal total weight but differing greatly in density, a rapid attenuation of internal harmonics is achieved, particularly reducing the undesirable metallic resonance of the metal bodies of conventional microphones. The improved tonal quality is achieved, not by uncoupling the acoustic mass of the housing, but rather, by tightly coupling the wood housing to a slender chassis on rails that support the ribbon. Advantageously, this cooperative effect also acts to dampen unwanted rumble and external shock outputs, and in a preferred embodiment, magnetic pole pieces are eliminated by designing air gaps between the chassis and the magnets. The chassis is a conductor and electrically connects the ribbon to a transformer, eliminating the need for solder connections. Thus the ribbon support system of the invention achieves a synergy of function by eliminating unneeded parts, simplifying assembly, and improving the tonal quality of the microphone.

30 Claims, 9 Drawing Sheets

(51) Int. Cl.
*H04R 1/28* (2006.01)
*H04R 9/08* (2006.01)

(56) References Cited

U.S. PATENT DOCUMENTS

| | | | | |
|---|---|---|---|---|
| 2,501,615 | A | 3/1950 | Pugh | |
| 2,552,331 | A | 5/1951 | Duncan | |
| 2,608,265 | A | 8/1952 | Eckardt | |
| 2,680,787 | A * | 6/1954 | Olson | H04R 1/38 181/158 |
| 2,699,474 | A | 1/1955 | Olson | |
| 2,963,557 | A | 12/1960 | Anderson | |
| 3,435,143 | A | 3/1969 | Fisher | |
| 4,049,926 | A | 9/1977 | Kasatkin | |
| 4,473,723 | A | 9/1984 | Hobrough | |
| 4,831,656 | A * | 5/1989 | Southern | H04R 1/04 381/160 |
| 6,060,976 | A | 5/2000 | Yamaguchi | |
| 6,434,252 | B1 | 8/2002 | Royer | |
| 7,900,337 | B2 | 3/2011 | Crowley | |
| 2006/0078152 | A1 * | 4/2006 | Royer | H04R 9/048 381/399 |
| 2007/0274555 | A1 * | 11/2007 | Crowley | H04R 1/06 381/399 |
| 2009/0279730 | A1 | 11/2009 | Sank | |

* cited by examiner

Fig. 4A
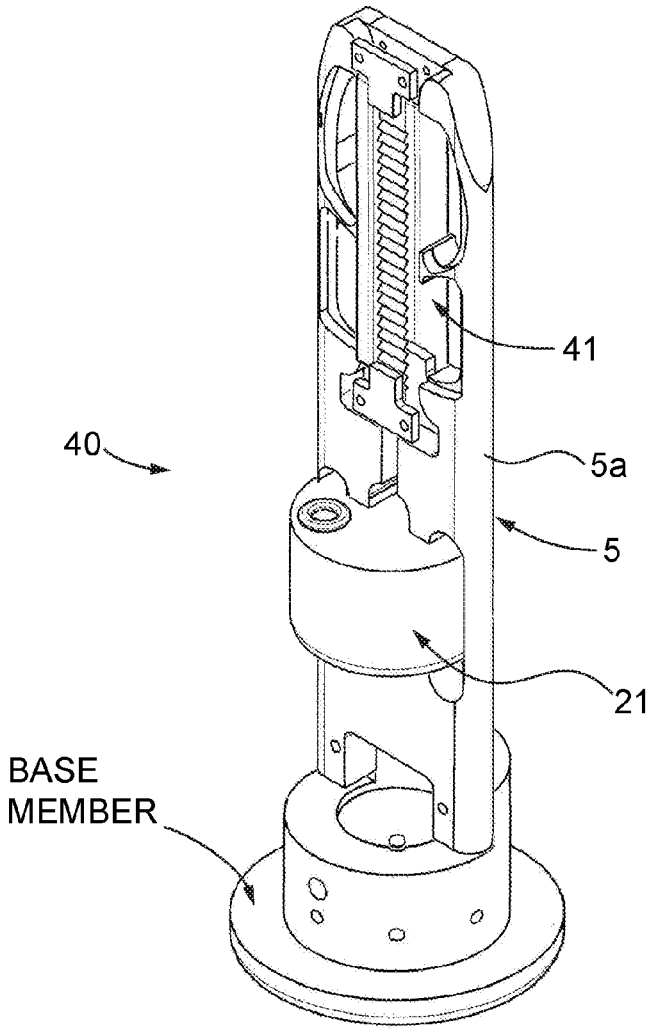
Fig. 4B
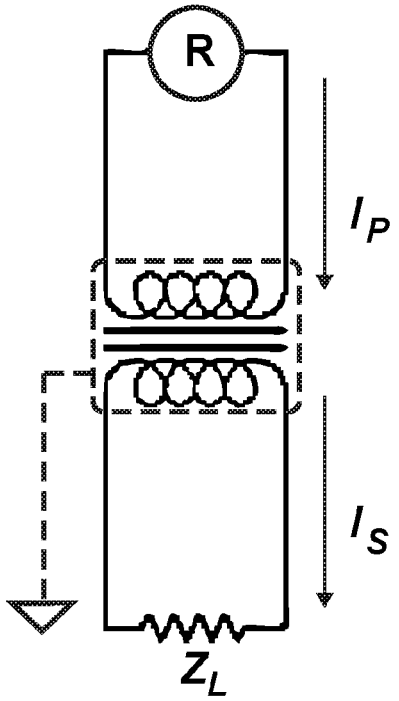
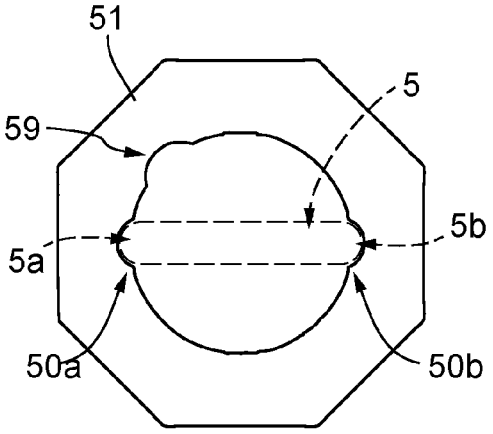
Fig. 5F

Fig. 5A
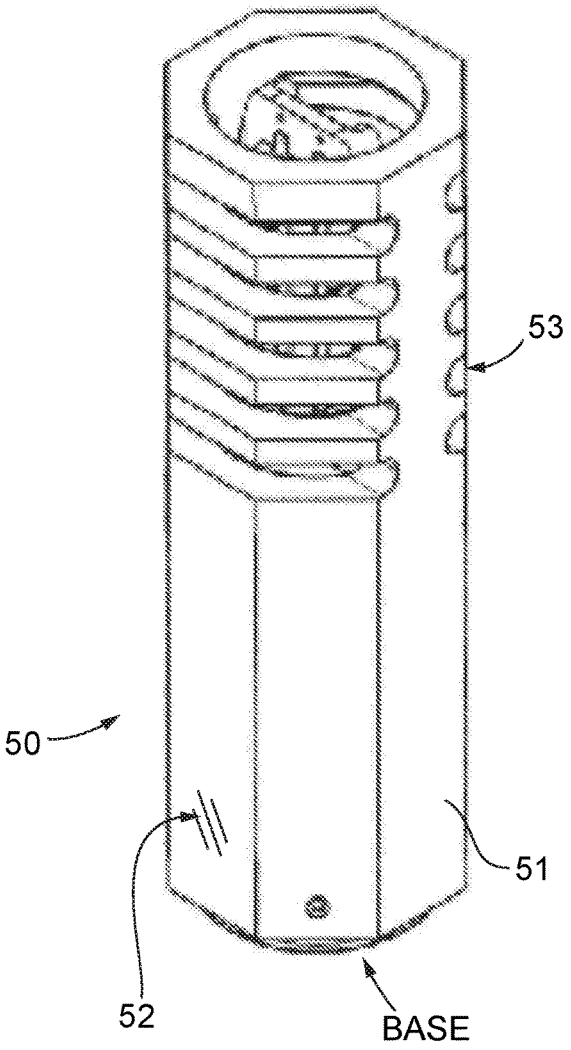
Fig. 5E
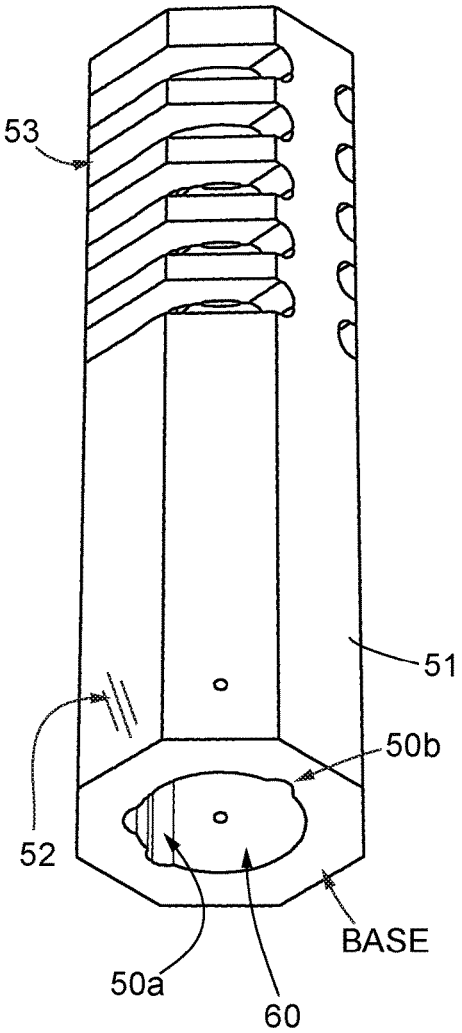
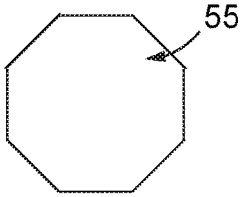
Fig. 5B
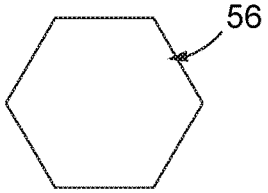
Fig. 5C
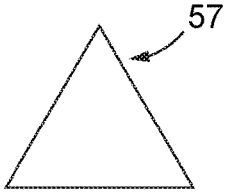
Fig. 5D

SECTION A-A

SECTION B-B

RIBBON
MICROPHONE
ASSEMBLY

RIBBON SUPPORT SYSTEM FOR ELECTRODYNAMIC MICROPHONE

CROSS REFERENCE TO RELATED APPLICATIONS

This application claims the benefit of priority under 35 U.S.C. § 119(e) from U.S. Provisional Patent Application No. 62/097,272 filed 29-Dec.-2014; said patent documents being incorporated herein in entirety for all purposes by reference.

GOVERNMENT SUPPORT

Not Applicable.

FIELD OF THE INVENTION

This invention relates to an improved ribbon microphone, and more particularly to high fidelity microphone having a metallic chassis supporting a ribbon and a wood, wood laminate or low impedance body, where the chassis and the body are impedance mismatched and acoustically coupled under compression.

BACKGROUND

Sound consists of alternating regions of compression and rarefaction and is transmitted directionally as a pressure wave. Olson, in U.S. Pat. No. 1,885,001 describes what has come to be known as a "ribbon microphone" for converting sound-driven motion of a thin strip of conductive material in a magnetic field into an electrical potential that can be amplified and has high fidelity in following the incident sound wave. Motion of the conductive ribbon cuts flux lines in a magnetic field and thus generates a potential in the metal. The microphone is termed "electrodynamic" because the potential matches the velocity of the ribbon in the magnetic field. The ribbon as disclosed by Olson is crafted to be displaced by the impact of the pressure wave and has little or no elastic (i.e., "restorative") modulus. Typically aluminum is used, and the ribbon is transversely corrugated to reduce any stiffness. Because of its fidelity at a broad mid-range of frequencies, microphones of this type were instrumental in growing the popularity of the early broadcasting industry and in manufacture of high quality reproductions of sound recordings. These microphones are experiencing renewed appreciation for their technical qualities and improvements continue to be made.

Duncan, in U.S. Pat. No. 2,552,311 offers a solution to the problem of a loss of response at higher frequencies. (As noted by Olson, the shorter the acoustic circumference around a "baffle" or pole piece, the greater the high frequency range will be; a larger pole piece will result in a lower high frequency roll off; high frequency roll-off (i.e., any lack of response to higher frequencies) is due to the circumference of the pole piece being longer than the peak-to-peak distance of a sound wave in air, which grows shorter as the frequency increases.)

Duncan teaches magnetic "pole shoes" that are shaped to taper along the length of the ribbon so as to increase the microphone response at higher frequencies. However, the frequency response is surprisingly irregular. A related approach is developed in Fisher, U.S. Pat. No. 3,435,143, who tapers not only the magnetic pole pieces, but also the ribbon. While narrowing the ribbon is disadvantageous because it increases electrical resistance, Fisher taught that the shape of the magnetic pole pieces could be tapered almost to a point so as to solve the path length dilemma. Royer, in U.S. Pat. No. 6,434,252 extends the same approach by concentrating the magnetic field in a gap between two pairs of opposing magnets set angularly with respect to the ribbon so as to taper, where the gap is defined by a thin pole strip on each side of the ribbon. Each pole strip connects like magnetic poles, N to N and S to S. The ribbon is tuned by tensioning to obtain a flat frequency response when amplified. Whereas Olson taught a "limp" ribbon having a very weak restorative stiffness and a native resonance frequency of perhaps 10 Hz, Royer teaches a resonant mode at 70-90 Hz. More details of the pickup transformer are described in companion US Pat. Publ. No. 2006/0078152. The microphone is bidirectional, accepting sound from front and rear while rejecting sounds from either side. U.S. Pat. No. 6,434,252 also teaches an offset ribbon for capturing higher amplitude sounds. Disadvantageously, the microphone requires high precision assembly and maintenance.

As detailed in the earliest descriptions (U.S. Pat. No. 1,885,001), the ribbon and apposing magnets create a sound shadow. A sound wave will encircle a solid body, termed here a "baffle", and can be visualized as spreading ripples on the surface of a pond; with destructive interference where the waves wrap around and collide behind the solid body. This is depicted in FIG. 1A. Thus, dependent on the frequency, the compression wave is split, and on the back of the ribbon may be phase-shifted relative to the corresponding compression wave incident on the front of the ribbon, so that one wave cancels out the other. As the half-wavelength of the wave shortens relative to the fixed path length from front to back of the ribbon, some of the energy of the wave is lost in interference (where compression wavelets on the back of the ribbon oppose the compression wavelet incident on the front) thus limiting the electrical potential that results. This phenomenon was demonstrated by Olson by using baffles of varying width to cap the frequency response range. In a preferred embodiment (perhaps state of the art at the time), Olson crafted a baffle wall from a fence of cylindrical rods, each picket of the fence separated by a gap, the rods being connected at the ends by a narrow pole piece proximate to the ribbon. Olson was able to show a response limit approaching 10 KHz using a 1 inch baffle wall versus a 1 KHz limit using an 8 inch baffle wall. One skilled in the art will recognize that a reduction in the path length around a baffle, pole piece, shoe or magnet member will result directly in an improved response to higher frequencies. Sound above 20 KHz is generally not heard by the human ear, so the goal of full range sound quality is not unreachable and a significant body of work has been directed at achieving acoustic fidelity over a higher frequency range.

However, as sensitivity has increased (due to newer and stronger magnetic materials such as rare earth permanent magnets), there is also an increasing need for improvement in suppression of resonance transfer from the body of the microphone, which may be responsible for some of the peaks noted by Duncan in FIG. 4 of U.S. Pat. No. 2,552,311. This is particularly problematic for the metallic microphone bodies that are used to protect the delicate ribbon, and result in undesirable vibration, rumble, harmonic resonance of the protective body, resonance from higher sound pressure levels (such as from loud musical instruments or speakers), and from external bump-associated extraneous signals. Crowley, in U.S. Pat. No. 7,900,337, depicts a suspension for isolating the microphone body and the ribbon to reduce external bumps and resonance as shown in FIGS. 3 through 5, where elastomeric cords that dampen induced body motion are depicted. The ribbon as taught by Crowley, is uncoupled from the body by these acoustically lossy spacers (col 2, lines 56-65).

Similar teachings are seen for example in US Pat. Publ. No. 2009/0279730 to Sank and are accepted teachings in the art. The prior art teaches that the ribbon transducer and the external housing or frame are best uncoupled from each other—ensuring isolation of the ribbon from sounds originating from or resonating from the frame or housing support. This results in the somewhat ungainly suspension systems as devised by Sank and Crowley and in the widespread use of lossy spacers, including rubber or silicon washers, between the housing body and the ribbon-magnet transducer assembly.

Part of the attractiveness of ribbon microphones is the fidelity of the sound reproduction, but also a characteristic dampening that tempers or "colors" the higher frequencies. It is desirable that any improvement in ribbon microphones preserve or even enhance this quality.

Thus, there is a need in the art, for a ribbon support system that preserves the desirable qualities and overcomes the disadvantages of conventional ribbon microphones, supporting the ribbon while eliminating extraneous noise and internal resonances. Surprisingly, accessory pole pieces or shoes may be entirely eliminated from the magnet design, and by acoustically coupling the ribbon to a lower impedance body material, the rich tonal quality or "color" of ribbon microphones is enhanced, not deadened.

SUMMARY

Ribbon microphones produce high fidelity sound but are sensitive to resonances in the body and to external shocks and vibrations picked up in the output. I approached this problem from a unique direction by coupling, under pressure, the microphone transducer to the body. Instead of producing the microphone housing of metal, the housing is made of wood or another suitable material having a lower characteristic impedance and density and a ribbon transducer assembly with metal support chassis having a higher characteristic impedance and density. By engineering the body housing and the ribbon support chassis having a similar or equal total weight but differing greatly in density, a rapid attenuation of internal harmonics is achieved, particularly reducing the undesirable metallic resonance of the metal bodies of conventional microphones. The improved tonal quality is achieved not by uncoupling the acoustic mass of the housing, but rather by tightly coupling the housing to a slender chassis that supports the ribbon. Advantageously, this cooperative effect also acts to dampen unwanted rumble and external shock, and in a preferred embodiment, where the magnet pair is used without accessory pole pieces the sound path from front to back is shortened (FIGS. 1A, 1B), response at higher frequencies is improved. This effect is enhanced by allowing for generous air gaps between the chassis and the magnets. In my designs, the chassis is an electrical conductor that forms a circuit with the ribbon to the transformer. Thus the ribbon support system of the invention achieves a synergy of function by eliminating unneeded parts, simplifying assembly, and improving the tonal quality of the microphone.

Advantageously, the wood body is coupled to the metal chassis in a way similar to the way in which a wooden string instrument body is coupled to a vibrating string. Because the body is made of wood (or another dampening material), a unique and satisfying tonal color is achieved. More generally, any residual un-attenuated vibration will have a tonal quality of the housing materials (typically selected woods, wood laminates, or a material of mismatched impedance to the chassis), imparting a distinctive warmth, color or timbre to the microphone output that may be a signature sound. Sound is not reflected at the interface between the wood and the metal, but is absorbed into the wood and reverberated softly as an overtone with the complexity of the grainy cellular structure, an effect that cannot be achieved by the structures of the prior art.

Furthermore, accessory pole pieces may be eliminated from the microphone. The resulting ribbon support system is surprisingly simple, and surprisingly, need for a "flux frame" is also eliminated. The magnets extend parallel to and above and below the ribbon and are easily inserted into precision slots in the chassis, eliminating the need for fixtures or glue. Typically the chassis is made of a Martensitic stainless steel, allowing for high precision machining, although Austenitic steels and ceramics may also be used.

In a preferred embodiment, the magnetic strength of the magnets is chosen so that the path length "L" of sound from one side of the ribbon to the other is configured so that interferences are avoided below about 15 KHz. Air gaps are defined between the magnet and an outer chassis that supports the clamps used to secure the ribbon in place. These air gaps form a transparent window for sound on either side of the ribbon.

The housing includes one or more flats that demarcate the orientation of the ribbon inside the body, i.e., a particular flat of the face of the housing may be used to align the microphone ribbon so as to be normal to the incident direction of a sound wave. In a preferred embodiment, the housing is formed as an octagonal tube (having eight flat faces) in which the ribbon transducer assembly and transformer are inserted. The flats assist artists and sound engineers in positioning the microphone relative to the sound source. This saves time and production costs by reducing the number of sound checks and retakes due to sub-optimal microphone orientation. The flats further allow creative modifications of the sound output: the "front" flat side of the microphone normal to the sound source provides a higher output and for more of the wood body character, and orienting the microphone to increasingly angular flats results in increases in higher frequency response while reducing overall output and wood body character.

The elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIG. 4A is a perspective view of an internal ribbon support system assembly.

FIG. 4B is a basic schematic showing the electrical connection from the ribbon (R) through a transformer to an amplifier. A three-pin adaptor includes an electrical ground to the transformer shield or can.

FIG. 5A views a housing body member in perspective

FIGS. 5B, 5C and 5D are alternative housing body member shapes in plan view. FIG. 5E is a sec ond view of an octagonal housing body showing the internal cavity for receiving the chassis and a pair of guide slots for receiving the rails. FIG. 5F shows the base in plan view.

FIG. 6B is at cross-section A-A, showing a cutaway lateral view.

Figure 1A:
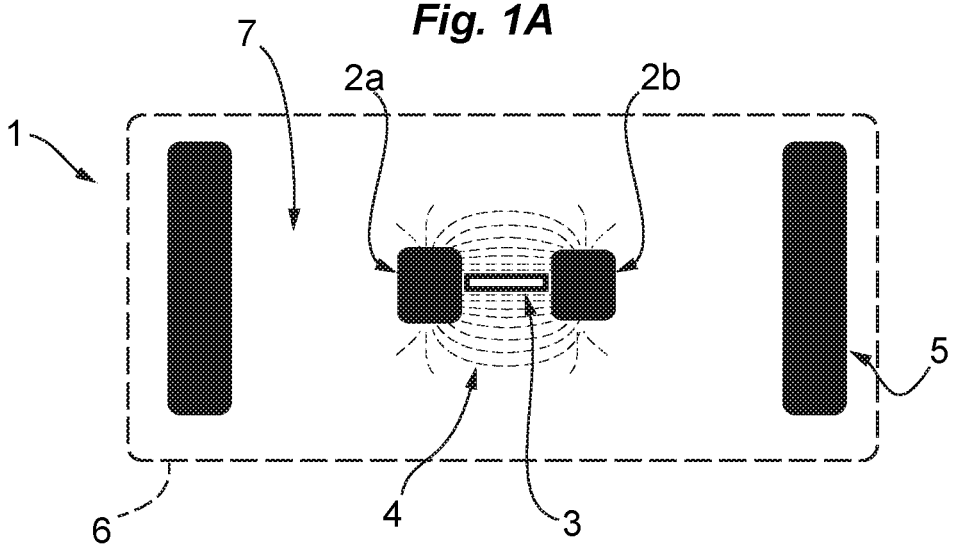
FIG. 1A is a schematic of a ribbon microphone transducer with support housing.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

Glossary

Certain terms are used throughout the following description to refer to particular features, steps or components, and are used as terms of description and not of limitation. As one skilled in the art will appreciate, different persons may refer to the same feature, step or component by different names. Components, steps or features that differ in name but not in structure, function or action are considered equivalent and not distinguishable, and may be substituted herein without departure from the invention. Certain meanings are defined here as intended by the inventors, i.e., they are intrinsic meanings. Other words and phrases used herein take their meaning as consistent with usage as would be apparent to one skilled in the relevant arts. The following definitions supplement those set forth elsewhere in this specification.

Acoustic impedance "Z" is the ratio of amplitude p to volumetric flow U in a medium. Formally, $Z=p/U$ (where p is the applied acoustic pressure and U is the acoustic volumetric flow rate. Impedance is typically given in $Pa \cdot m^3/s$ and is a measure of the opposition that a system presents to an acoustic flow when an acoustic pressure is applied to it. Acoustic impedance may vary strongly with frequency.

Also more relevant to the present invention, "characteristic acoustic impedance" (Z') of a material is defined as the product of its density (p) and acoustic velocity (V) and is measured in Rayleighs (Rayl). Thus for example the acoustic impedance of a softwood across the grain is on the order of 1.6 Rayl; selected stainless steels on the order of 46 Rayl, some brasses about 41 Rayl, and TEFLON® is 2.97 Rayl. The characteristic impedance Z' of wood is very much dependent on grain orientation, a property termed "transverse isotropy", and is important in that the grain orientation may be used to absorb sound from a high impedance material rather than reflect it at the interface.

Acoustic attenuation "Q" is a measure of the energy loss of sound propagation in media, and is the sum of thermal conversion of sound energy plus acoustic scattering. Acoustic attenuation in a lossy medium promotes dampening and noise reduction but by selection of interfacial materials and masses may instead be used to add color to a tone. Wood on metal for example absorbs sound by both its elasticity and by acoustic scattering, and adds a tonality that is complementary to the properties that make ribbon microphones attractive to audiences.

"Composite materials" refer to materials made from two or a plurality of constituent materials having significantly differing physical or chemical properties, such that when combined, the resultant composite has characteristics that are recognizable distinct from the individual components. These materials are also sometimes termed "composition materials" or simply, "composites." Composites include such materials as "micarta" (http://en.wikipedia.org/wiki/Micarta, incorporated herein in full by reference), fiber-reinforced phenolics, and laminated materials, where particularly preferred are lower density materials and layered materials having mixed densities enabled to dampen undesirable resonances. Given that the speed of sound in wood varies according to the grain, laminations having variably oriented grain may also be useful composites for dampening undesired resonances. Useful laminating resins include epoxy and polyester, while not limited thereto.

A "pole piece" is a structure composed of material of high magnetic permeability that serves to direct the magnetic field produced by a magnet. A pole piece attaches to and in a sense extends a pole of the magnet, hence the name.

Pitch: Pitch describes a sound as heard by the ear, and is interchangeable with the wavelength or frequency of a sound wave in air.

Color: One of the basic elements of music is called "color," or "timbre". Color includes higher harmonics and overtones. A guitar and a flute, for example, have differences in sound; it is these differences that are the color of the sound. The harmonics at the beginning of each note—the attack—are especially important for color. The invention realizes a microphone that has "color", much like a musical instrument.

Vibe: is a term used by musicians to describe the responsiveness and liveliness of an instrument. Good "vibe" means that the microphone responds quickly, and develops a rich harmonic overtone spectrum.

Reverberation: A note played in a small space will reverberate. Reverberation, also termed "verb", is nothing more than lots and lots of little echoes, but also can be produced electronically.

Dynamic level: The loudness or softness of a sound.

Resonance: refers to the sympathetic vibration of two structural elements sharing a natural resonance frequency. Natural resonance frequencies are determined by the vibrational modes of the material and its dimensions or mass.

Harmonics: refers to standing waves or overtones at integer multiples of a fundamental frequency.

General connection terms including, but not limited to "connected," "attached," "conjoined," "coupled", "secured," and "affixed" are not meant to be limiting, such that structures so "associated" may have more than one way of being associated. "Acoustically coupled" indicates a connection for conveying a sound pressure therethrough.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments.

Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. The various components, features, steps, or embodiments thereof are all "preferred" whether or not specifically so indicated. Claims not including a specific limitation should not be construed to include that limitation. For example, the term "a" or "an" as used in the claims does not exclude a plurality.

"Conventional" refers to a term or method designating that which is known and commonly understood in the technology to which this invention relates.

Unless the context requires otherwise, throughout the specification and claims that follow, the term "comprise" and variations thereof, such as, "comprises" and "comprising" are to be construed in an open, inclusive sense—as in "including, but not limited to."

The appended claims are not to be interpreted as including means-plus-function limitations, unless a given claim explicitly evokes the means-plus-function clause of 35 USC §112 para (f) by using the phrase "means for" followed by a verb in gerund form.

A "method" as disclosed herein refers to one or more steps or actions for achieving the described end. Unless a specific order of steps or actions is required for proper operation of the embodiment, the order and/or use of specific steps and/or actions may be modified without departing from the scope of the present invention.

DETAILED DESCRIPTION

A general structure of a ribbon microphone of the invention is shown schematically in FIG. 1A. As seen in plan view, the structure includes a pair of magnets positioned at opposite edges of a ribbon such that a magnetic flux is disposed generally crosswise between the magnets and parallel to the faces of the ribbon. The ribbon is depicted as if in section and is perpendicular to the plane of the drawing. The heart of a ribbon transducer assembly is defined by the ribbon and its paired magnets. Magnetic flux lines are shown sweeping across the ribbon and are generally parallel between the magnets. A chassis supports the transducer assembly and is acoustically coupled to an external body or housing by a compression (alternatively termed "interference") fit. An air gap separates the magnets and the chassis; the air gap allowing sound waves (figuratively "wavelets") to encircle and envelop the ribbon from either side.

Figure 1B:
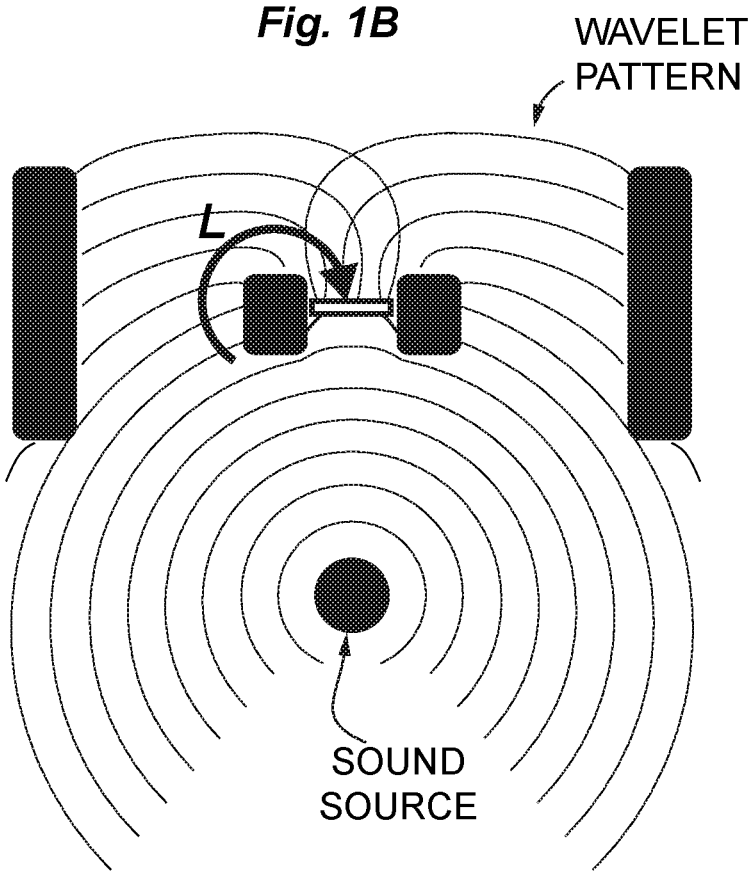
FIG. 1B shows a field of sound around ribbon microphone components.

An analysis of the motion of individual wavelets on a ribbon transducer of the invention is shown in FIG. 1B. The wavelets may indicate a continuous propagation of a single frequency or may indicate a progression of a single pulse as it encircles the ribbon. Each wavelet shown here will strike the front of the ribbon first. Wavelets admitted through the air gaps on either side of the ribbon-magnet assembly will propagate so as to strike the back side of the ribbon a short time later. Because the ribbon is generally flaccid and of low mass, it will be displaced by as little as a whisper of a sound wave according to any pressure differential across the ribbon. As the ribbon moves, it intersects and cuts magnetic flux lines, and because the ribbon is electrically conductive, a potential is generated in a circuit attached to the ends of the ribbon that can be picked up by a transformer and passed to an amplifier.

The response curve for a ribbon microphone is relatively flat at lower and mid-range but tends to diminish at a frequency that is characteristic of the path length "L", where "L" is a free path distance (not in a straight line) between the front of the ribbon and the back, the distance covered by a sound wave between first striking the front of the ribbon and then striking the back, as described in detail by Olson in U.S. Pat. No. 1,885,001, which is incorporated by reference for all it teaches.

As shown in FIG. 1A, the path length L is equal to a partial circumference of a magnet and passes through an air gap between the magnet elements and a chassis element, shown here figuratively. Note that no accessory pole pieces are shown: only the permanent magnets. The magnets are suspended between a top aspect and a bottom aspect of the chassis as will be described in more detail in FIG. 2, and are seated next to the ribbon.

Other than a gradual treble roll-off, the frequency response of ribbons tends to be very flat especially in the mid-range—due to the lack of resonances within the ribbon element. Ribbon microphones, in comparison to condenser microphones, tend to be superb at bringing out the body and 'size' of voices and instruments. They are particularly suited to sources that may sound "strident" or shrill and tinny when recorded with a condenser microphone.

Integral to the transducers of the invention is a low impedance housing that is acoustically coupled to the chassis. This will be discussed in more detail with reference to FIG. 5A, where a fully assembled microphone with representative housing is drawn.

Figure 2:
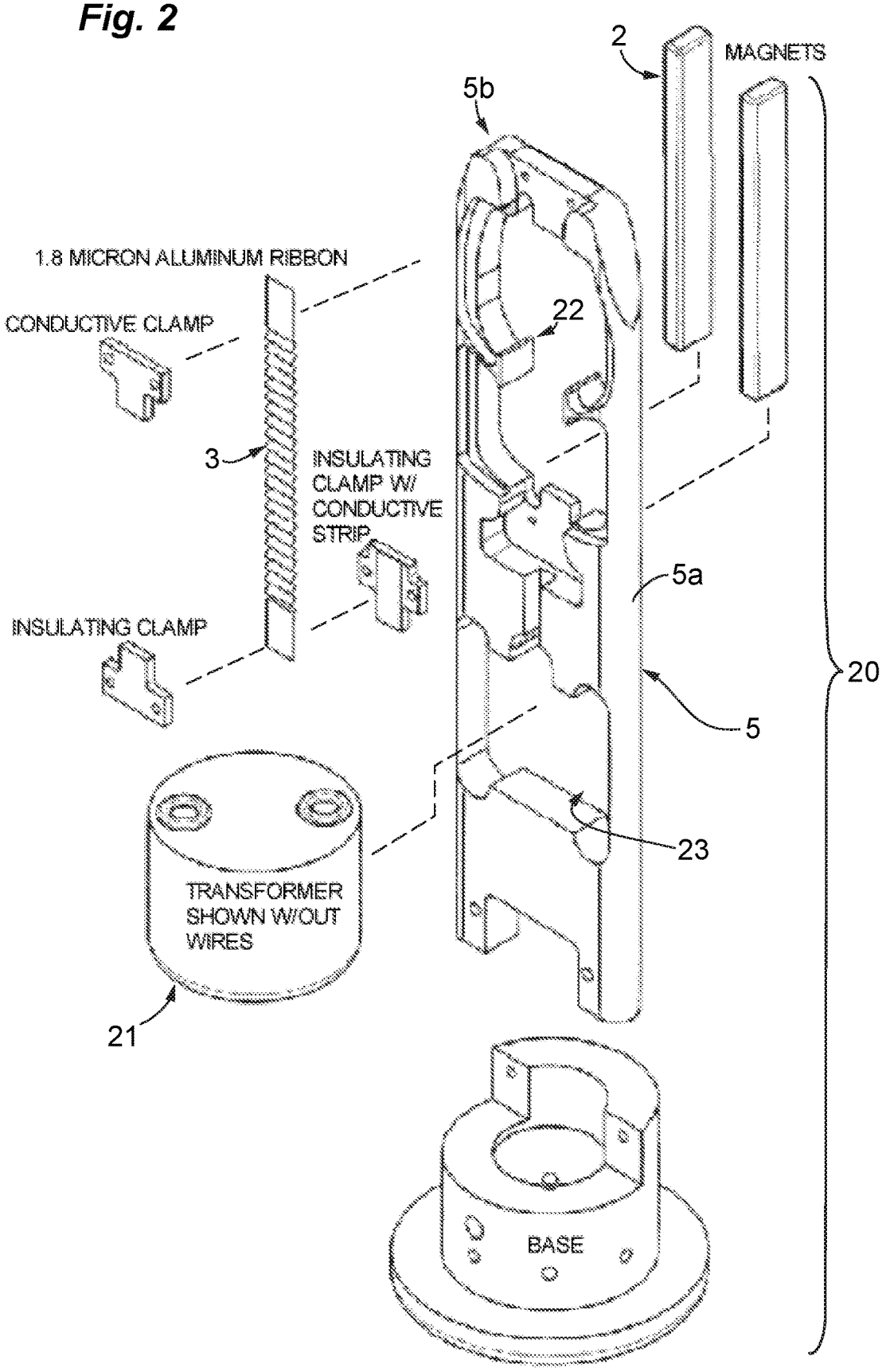
FIG. 2 is an exploded view of a ribbon support system of the invention.

Referring to FIG. 2, in broad overview, the ribbon transducer assembly, shown here without housing, includes a ribbon, a pair of magnets, a chassis, a transformer, and a base mount with adaptor for connecting the microphone to an external amplifier. The ribbon transducer assembly is fitted into a housing body that receives the chassis under compression. Thus the chassis engages both the ribbon transducer and the external housing and serves as an acoustic coupling between the two. A transformer is cradled at the base of the chassis and is electrically connected to the ribbon transducer. The base also includes standard XLR pins for making connections to an external amplifier as shown in FIG. 4B. More structural details will be described below.

The side edges or "rails" of the chassis aid in assembly. Each vertical rail slides into a hollow center of a solid block housing (see FIG. 9). By machining mated slots inside the housing, a directional fit is ensured so that the external sound flats of the housing may be used by sound engineers and a particular flat is identifiable as being parallel to the front face of the ribbon, an orientation in use that is chosen for optimal sensitivity and pickup.

The ribbon is central to the transducer and is sized for particular applications. The ribbon is typically made from nearly pure aluminum or a metal-coated Mylar and has a flexible substructure. Corrugation is preferred as was first disclosed by Olson, but variants are shown in U.S. Pat. No. 8,218,795 and Pat. No. CN 2030784 U, for example. The thickness is a tradeoff between output signal strength and durability. In typical applications, ribbons from 0.6 micron aluminum up to 4 microns are useful. A preferred thickness is about 1.8 microns when aluminum metal (99.9% pure) is used and the corrugations are typically formed by bending, such as with a toothed roller and a mating platen.

The ribbon is tuned to about 15 to 20 Hz. Royer in U.S. Pat. No. 6,434,252 describes a tuning process in which the ribbon is stretched to resonant mode at about 70-90 Hz, but this overlaps the 82.4 Hz E string on a base guitar, and is expected to cause audible exaggeration at the frequency when excited.

Generally the ribbon is flaccid or "limp" and responds to deflection without any internal restorative force or stiffness. A small level of tensioning may be applied if desired, but for maximum sensitivity, the mass of the ribbon must be small enough that even a very gentle sound wave is capable of pushing and pulling the ribbon back and forth through the magnetic flux. If the ribbon is too delicate, the ribbon may have to be periodically replaced because of breakage.

U.S. Pat. No. 7,900,337 to Crowley is incorporated in full by reference and discloses vapor deposition and electrodeposition of metal ribbons having no residual bending stresses (bending can lead to microfractures and work hardening). Crowley also discloses a number of composite ribbon materials, including more highly electroconductive layers. Also incorporated by reference is expired Chinese Pat. Doc. CN 2030784 U to Zhongyi, which discloses metal-coated plastic film ribbons.

Interestingly, three-dimensional printing of ribbons has become possible and may be used in place of vapor deposition to achieve an unstrained ribbon with a variety of corrugation periodicities, including diamond corrugation. Three-dimensional printing may also be used to produce combinations not previously realized, such as an aluminum ribbon having no residual bending stress, and further wherein the ribbon is coated with a nanoparticulate of a highly conductive material such as graphene or Fullerenes, or where alternating molecular layers are built up by successive passes with differing feedstocks. Advantageously, the printer may be used to form a fully integrated wire to the transformer lead, eliminating the need for a solder connection. 3D printing may also be used to form the precision chassis "hoop" (the supportive bracket for the ribbon), if desired.

The ribbons of the inventive microphones disclosed here are bent on a jig as currently practiced, as are most ribbons in commercial and hobby use. Alternative ways to reduce bending stress include use of jigs having sinusoidal surface patterns rather than teeth, and use of materials with a plastic backing such as MYLAR®, having a polyester backing and a metallized layer formed by deposition of aluminum on the plastic. Metallized polymeric films are available in many forms and may be obtained with additional electroconductive layers. Carbon black films are available. The films may be stretched if desired to form a relatively flaccid ribbon, provided care is taken to provide adequate conductivity.

Aluminum may be treated with carbon black or Fullerene layers to improve conductivity. Aluminum alloys and coatings may also be used to reduce surface oxidation. Plastic layers may be fused to the aluminum to improve durability and shock resistance. Other conductive metals such as gold, titanium, and ferrous alloys may also be used to form suitable ribbons, provided the inertial mass of the ribbon is kept low and the material is resistant to work hardening.

Ribbons are mounted in the transducer assembly in a variety of ways. As preferred here, clamps are used. The clamps will generally "sandwich" the aluminum ribbon against the chassis, and include a fastener for tightening. The clamps are either conducting or insulating according to the circuitry and the electrical connections. Each end of the ribbon is supported by a clamp affixed to the metal chassis. Generally the ribbon is tensioned lightly to a chosen resonant frequency, typically less than 50 Hz as currently practiced. The ribbon has a slight but non-zero elastic moment and hence an essentially zero restorative force. Thus clamping a ribbon onto a transducer chassis is a very delicate operation.

The clamping system is part of an electrical loop that follows the ring bracket from the chassis and returns to the ribbon through the transformer. The top clamp and fasteners are electrically conductive and part of an open circuit between the ribbon and the chassis. The bottom clamping assembly includes insulative materials so that the bottom end of the ribbon may be contacted with the transformer primary winding input without shorting to the chassis. Due to the precision of the machined chassis piece, I am able to use conductive fasteners that do not contact the lower portion of the ribbon. A conductive layer on the lower clamp tab facing the ribbon is used to ensure a low resistance contact to the transformer.

In addition to supporting the ribbon, the transducer chassis has other functions. It holds the magnets in place in an exact position next to the ribbon (see FIG. 3B) and defines air gaps on each side of the magnets. The chassis includes a "hoop" or "hoop" bracket that supports the ribbon-magnet transducer at the top and bottom, the bracket defining air gaps on either side of the magnet pair. Precision slots at top and bottom of the chassis are used to mount the magnets without any adhesive or fasteners, an advance in the art. Neodymium magnets producing an effective ribbon voltage can have a cross section as small as ⅛"×⅛" or smaller. Because the chassis holds the magnets in place by only supporting the ends, it eliminates the need for accessory pole pieces, immediately reducing path length L to a partial circumference of each magnet. With this improvement, high frequency roll off can be increased to around 16 KHz as currently practiced. In contrast, the magnets and pole pieces in most conventional ribbon transducers are glued to the ribbon chassis, thereby increasing the distance the sound must travel to reach the back of the microphone.

There are other ways to increase the high frequency performance of ribbon microphones (such as with high frequency resonator plates) but not without other drawbacks (increased resonance that destroys the microphones ability to translate high frequency transients and increased self-noise). As shown here, using ⅛" magnets without accessory pole pieces, path length L is reduced to less than 10 mm, enabling a significant extension of frequency response without treble roll off. Further improvement is achieved using magnets graded N42 or higher. Path length L in the range of 5 mm to 250 mm, more preferably about 10 mm (0.375 inches), has been found to be practical for most applications with the improved design.

As can be seen in exploded view, FIG. 2, the entire effective length of the ribbon between the electrical contacts is within the parallel flux field of the magnets. Each magnet extends into a top and bottom slot in the chassis such that the depth of the slots is greater than the electrical contact points for the ribbon clamps. The contacts are shaped with a nose that extends into the magnetic field. In this way the entire effective length of the ribbon is saturated by the magnetic flux field which flows in generally parallel lines across the faces of the ribbon. This aids in charge separation to the ribbon ends and improves the overall microphone response.

The magnets are held in place at their ends, allowing the audio signal to traverse the shortest path around the magnets with a cross section as small as 0.125"×0.125" but not limited to that size. Securing the magnets by their ends as shown above further allows the magnetic flux field to encompass the entire ribbon element. Duncan and Fisher tapered the pole pieces to allow for the short path, but this also results in a lower magnetic flux density reducing the output.

As shown here, a small dampening finger or "rib" is inserted at the middle of the magnet to reduce any resonance node that could otherwise form. The small tabs that touch the middle of the magnet on each side exert a slight pressure on each magnet preventing it from ringing. These tabs are not necessary for the function of the microphone but follow my original design intention to reduce as much internal resonance as possible.

Magnets are preferredly neodymium magnets, but samarium-cobalt and AlNiCo magnets may also be suitable if the magnetic flux density is sufficient. Higher strength magnets (for example rare earth magnets, such as neodymium magnets graded N42 or stronger) will produce a flux density that results in a usable signal output along the entire length of the ribbon. The ratio of magnet circumference at the ribbon edge to magnet flux density B* (the strength of the magnet per unit cross-sectional area in Teslas) is a compromise, but can be resolved by attention to the output signal impedance and selection of a suitable transformer. The custom magnets are magnetized "through thickness", not on the long axis. The ribbon-magnet assembly is core to the transducer and may be considered without its supporting chassis as a "subassembly" operative as depicted broadly in FIGS. 1A and 1B. The elimination of accessory pole pieces is an advance in the art and decreases the path length L through the air gaps on either side of the transducer subassembly.

The chassis also includes a separate cradle for the transformer under the ribbon. The cradle is designed to hold the transformer in compression fit to reduce axial vibration and rattling and the housing prevents radial vibration of the transformer body. Most current manufacturers either use screws to hold the transformer in place or use foam or cotton wadding to dampen vibrations. By acoustically coupling the transformer body to a housing having an impedance mismatch, sound conveyed through the transformer or resulting from transformer motion is deadened and the assembly is thus self-dampening.

Custom transformers may be designed to improve performance, but in many instances, a conventional transformer may be used, where winding ratios and gain are selected according to the ribbon output and the needed impedance of the amplifier. Because the cradle is electrically conductive, one of the ribbon ends connects to the chassis ribbon cradle. The closest ribbon end is wired to the transformer directly. The signal path utilizes the ribbon transducer chassis as the return path, limiting ohmic resistance in the circuit.

Advantageously, because the chassis is not needed to close magnetic flux loops, the ribs, transformer cradle and ribbon hoop bracket can be very minimal in their structural dimensions, as configured to provide only the stiffness needed to secure and support the ribbon-magnet combination in the housing under light compression. This is a technical advance in the art because a higher impedance chassis when coupled to a lower impedance housing body with a similar or greater mass will effectively dampen unwanted sound and harsh reverberations. The impedance mismatch allows residual sound to drain into the body like an acoustic sink instead of being reflected back at the ribbon as would occur if the body was uncoupled from the chassis and adds a tonal quality characteristic of the body material, thus allowing the engineer to select a tonal quality complementary to the microphone's use, such as in recording vocals, instrumental music, and the like.

Being under compression from the wood/composite body of the microphone, the chassis is acoustically coupled to the body. Most manufacturers attempt to decouple the transducer chassis from the body due to the un-tuned metallic construction of microphone bodies on the market today. By coupling, under pressure, the microphone transducer to a wooden or composite body, an effect is achieved that is analogous to the way a wooden string instrument is coupled to its strings. The housing body and the ribbon chassis assembly are similar in total weight but differ greatly in their densities; allowing for a rapid bidirectional attenuation of harmonic frequencies native to each part (body and transducer chassis) so that the ribbon output is not affected. This unlikely combination acts to dampen unwanted rumble, shocks, or the undesired internal metallic resonances of the metal bodies of other microphones. Furthermore, since the body is made of wood (or another dampening material), any undamped reverberation or vibration that are left un-attenuated will have the sonic characteristics of the material that is made of, in this case, wood or another suitable composite material, a highly satisfying complement to the warm resonance produced by a well-crafted ribbon microphone.

A preferred chassis material is electroconductive, stainless steel 416 for example. Stainless 416 is conductive, paramagnetic and precision machinable. It is a common misconception that stainless steels are non-magnetic. The misconception arises because the type of stainless most commonly in use is austenitic (such as SS types 304 and 310L), having a grain structure that is magnetically inert. But other stainless steels, including ferritic, martensitic, duplex, and precipitate-hardened stainless types are magnetic and may be used for the invention. Stainless 416 was chosen for the preferred embodiment because of its stiffness, machinability and corrosion resistance. It is a high-chromium Martensitic steel.

Within the open chassis, two air gaps are defined on either side of the ribbon-magnet transducer. These open windows allow sound to pass unimpeded from the front to the back of the ribbon. No pole pieces are used besides the magnets themselves. Thus an acoustic cavity is formed between the ribbon and the less dense and lower impedance body.

Figure 3B:
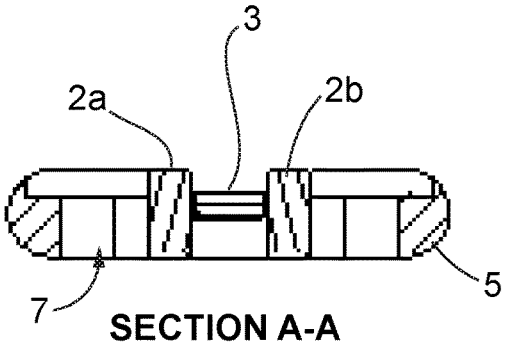
FIG. 3B is a plan view at section A-A of a ribbon support system assembly
Figure 3A:
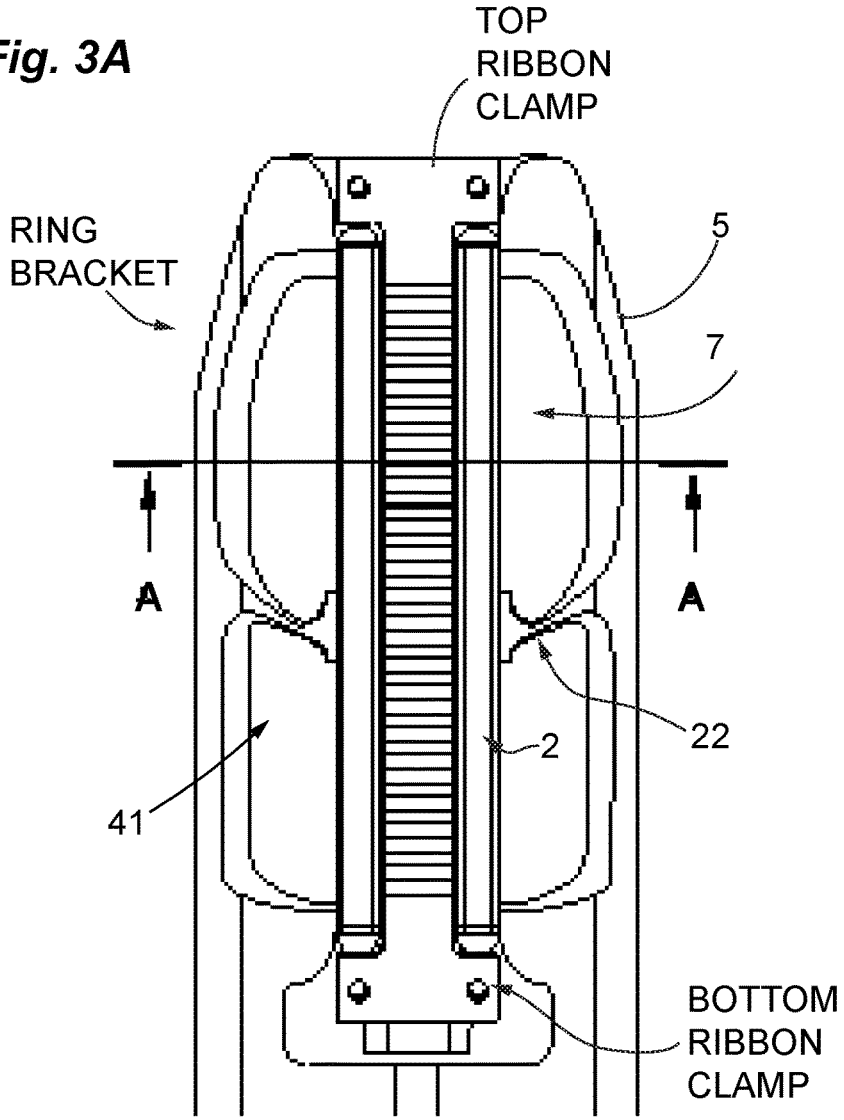
FIG. 3A is a detail view of a ribbon support system assembly.

More details of the ribbon support system assembly are shown in FIGS. 3A and 3B. Section A-A in FIG. 3B illustrates the close apposition of the magnets to the ribbon in the center and the air gaps defined by the outside face of each magnet and the corresponding vertical rib of the chassis frame. The ribbon is assembled in place with threaded fasteners inserted through small clamping members at the top and bottom ends of the ribbon. The bottom ribbon clamps (there are two) are generally insulative so that a direct connection may be made to the transformer. The top ribbon clamp is conductive and aids in connecting the ribbon electrically to the chassis, which serves as a return path for the electrical circuit joining the two ends of the ribbon.

FIG. 4B is a basic schematic showing the electrical connection from the ribbon (R) through a transformer to an amplifier. The three-pin XLR plug includes an electrical ground to the transformer.

Figure 9:
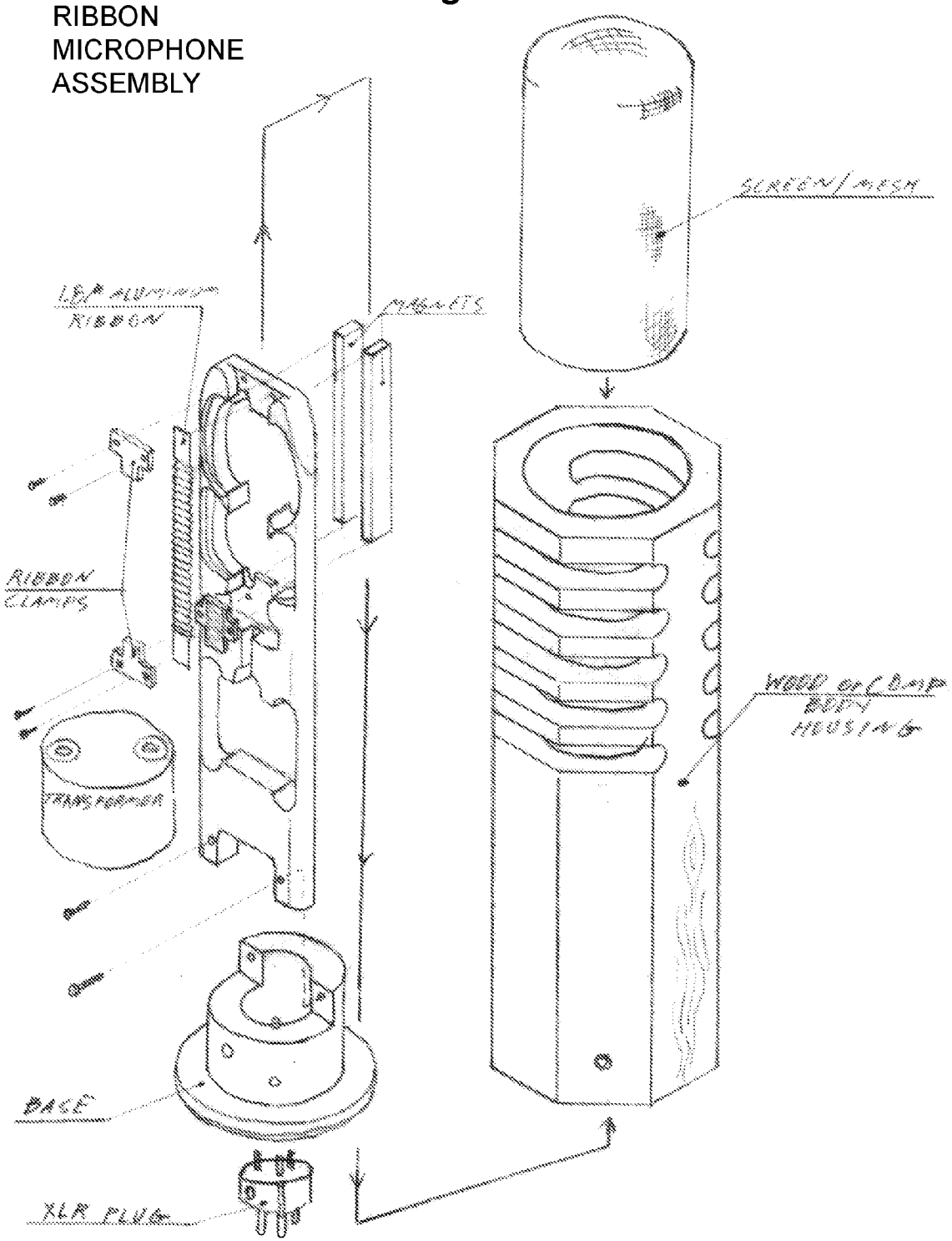
FIG. 9 is a summary overview of a ribbon microphone assembly and procedure.

A fully assembled transducer subassembly and supporting chassis is depicted in FIG. 4A. This is a sub-assembly and inserts under light compression into a hollow wooden body (or wood laminate or composite body) as shown in FIG. 5A and FIG. 9. A hoop bracket of the chassis supports the ribbon transducer with ribbon and magnets and a stands on two legs on an annular base configured to accept a standard microphone 3-pin jack. The jack is wired to the secondary winding output of the transformer, which is typically shielded and grounded. The base is attached to the ribbon transducer frame with 2 screws. The base serves as a stop when inserting the assembly into the housing, 4 screws around the base are used to secure the housing to the base. The annularity in the base serves as a universal adaptor plate, enabling the microphone to be connected to most standard cable receptacles no matter the shape of the exterior housing. The annularity houses an XLR (3 pronged) connector for electrically connecting the microphone to the pre-amp, typically via a cable receptacle. The XLR plug is held in place with an internal stop within the base and a left hand threaded screw that protrudes from the XLR into a larger hole in the side of the base.

FIG. 5A is a view of a first wooden body. Preferred woods include ash, basswood, hickory, and more exotic woods like cocobolo, ebony, koa, or lignum vitae. Both hardwoods and softwoods may be used. Thin veneers may be layered up by a process of lamination to produce composite materials having either an axial or a radial layer structure. Laminations allow for the inclusion of more materials with dissimilar densities (epoxy and other materials) which result on more active dampening while modifying the tonal qualities of the wood. The raw block is then shaped to have a hollow center dimensioned for receiving the ribbon support chassis under light compression and exterior faces are formed with "flats" characteristic of preferred embodiments. The purpose of the exterior flats is explained below. Also needed are acoustic windows to admit sound. These are generally styled to be effective and aesthetically pleasing when cut or milled through the wood body.

Instead of producing the microphone housing or body of metal as conventional bodies are made, the body is made of wood or another suitable composite material. The wood or composite body are acoustically coupled similar to the way a wooden string instrument is coupled to its strings, but by using impedance mismatch, using masses such that the body is greater or about equal to the ribbon chassis and materials such that the body is a lower impedance material and the chassis is a higher impedance material, a rapid attenuation of harmonic frequencies native to each part (body and transducer) is achieved. This acts to dampen unwanted rumble, shocks, or the undesired internal metallic resonances of the metal bodies characteristic of other microphones. Furthermore, since the body is made of wood (or another dampening composite material), any undamped reverberation or vibration that is left un-attenuated will have the sonic characteristics of the material that is made of, in this case, wood or another suitable low impedance material.

The body housing can be made in many different styles and shapes. Examples are shown in FIGS. 5B through 5D, which include octagonal, hexagonal, and triangular plan shapes. The current arrangement of the microphone is that of an octagonal tube. Thus the inventive microphones are not intended to be limited to 8 sides and in fact may be circular, rounded or ovoid in section. The housing design may use only 3 sides, or as many as 30, while not limited thereto and the flats need not be equally spaced. The broader flats of the microphone will allow artists and sound engineers to easily position and maintain optimal positioning relative to the sound source for recordings. This saves time and production costs by reducing the number of sound checks and retakes due to misplaced or poor microphone positioning relative to the source. The flats further give artists or sound engineers the ability to place a flat side of the microphone normal to the sound source for the highest output and for more of the wood body character to be present in the transducer. Alternatively, they may position the flats away (not normal) from the sound source, thereby increasing high frequency response, but lowering the output and tone produced by the wood or composite body. These external sound flats on the wooden body may be used to establish directionality of the ribbon front face during use.

The sound output from the fully assembled microphone of FIG. 5A is in the form of an electrical signal. The transformer takes a very small electrical signal that is developed from sound moving the ribbon within the magnetic flux field, and increases its output in voltage by a ratio of turns on a primary vs the turns on a secondary winding. There are many different types of step up transformers that could perform this job adequately. While a standard off the shelf transformer may be used to practice the invention, custom transformers may be designed. Of particular interest is the electrical impedance of the output signal, which must be mated to a suitably matched impedance of a pre-amplifier or a series of pre-amplifiers as described by Royer in US Pat. Doc. No. 20060078152, which is incorporated herein in full for all it teaches. Further evolution of transformers specifically adapted to ribbon microphones is needed and work is in progress.

Figure 6A:
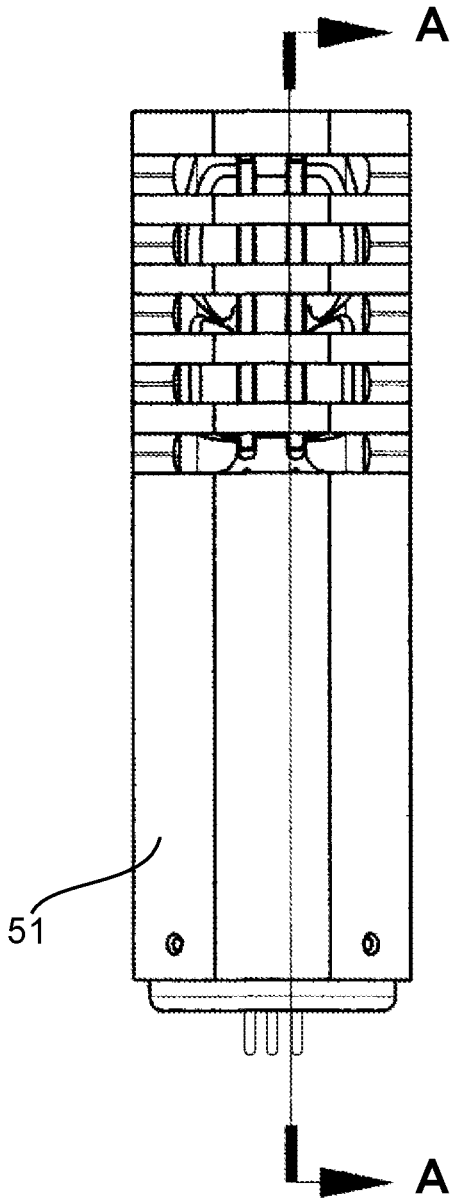
FIGS. 6A and 6B are views of a microphone assembly including octagonal housing with internal ribbon support system.
Figure 6B:
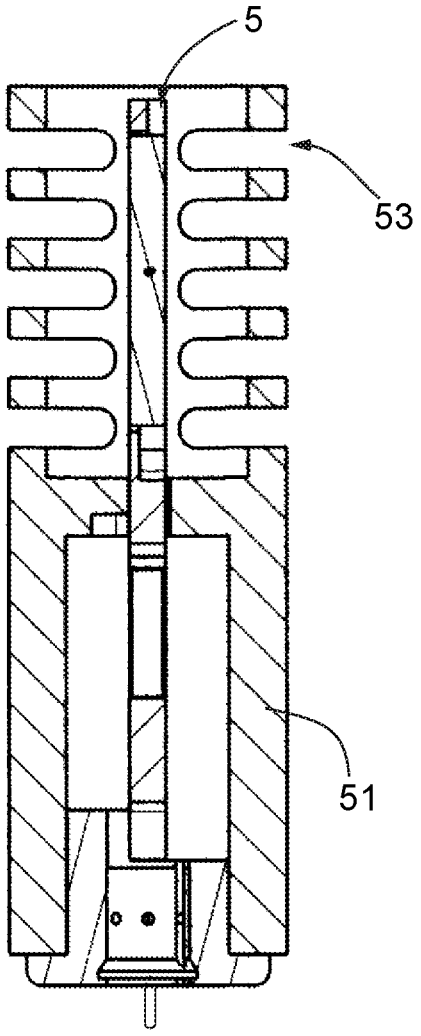

FIGS. 6A and 6B are elevation views of a microphone assembly including octagonal housing with internal ribbon support system. FIG. 6B is at cross-section A-A, showing a cutaway view to emphasis the slots that form acoustic windows.

Figure 7A:
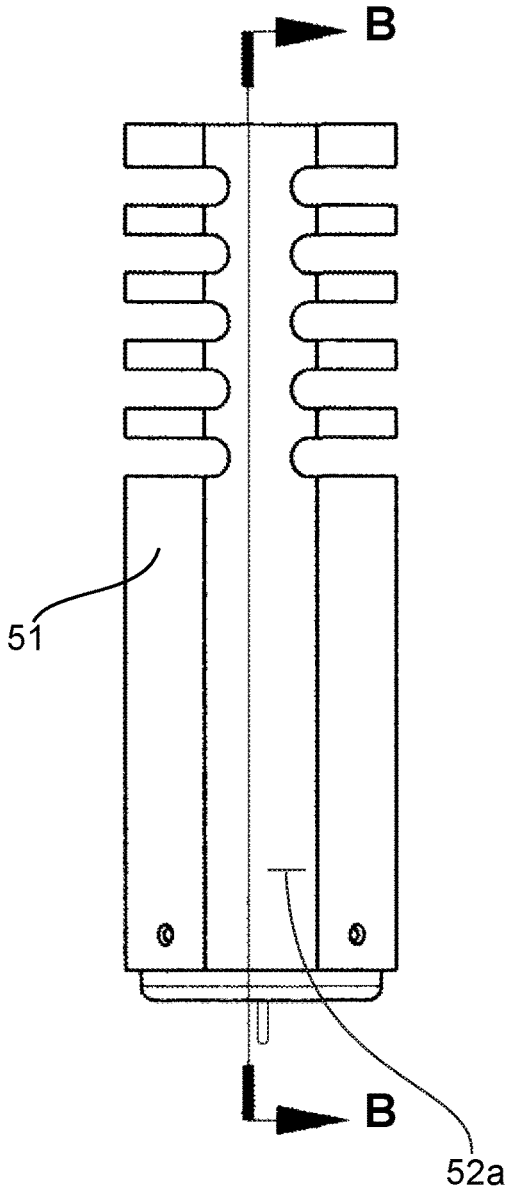
FIG. 7A is a side view of an octagonal housing.
Figure 7B:
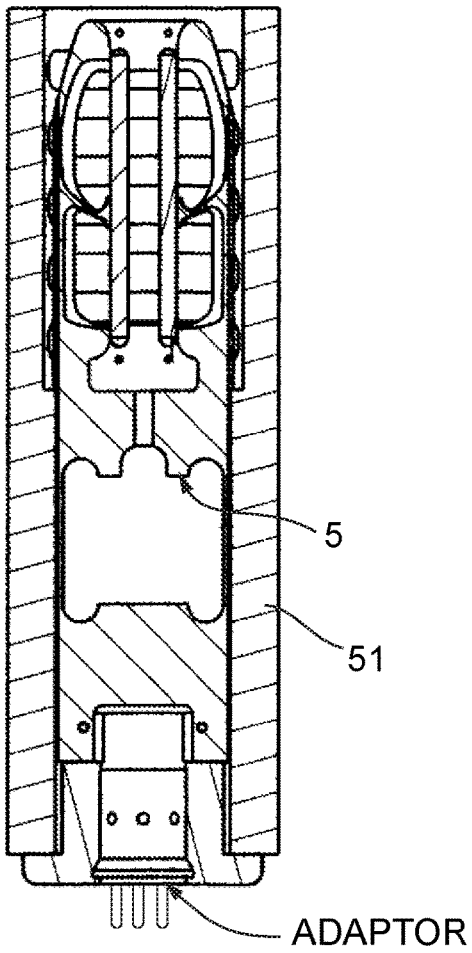
FIG. 7B is at cross-section B-B, showing a cutaway view of an internal ribbon support system.

FIG. 7A is a side view of an octagonal housing. FIG. 7B is at cross-section B-B, showing a cutaway view of an internal ribbon support system and ribbon front face.

Figure 8A:
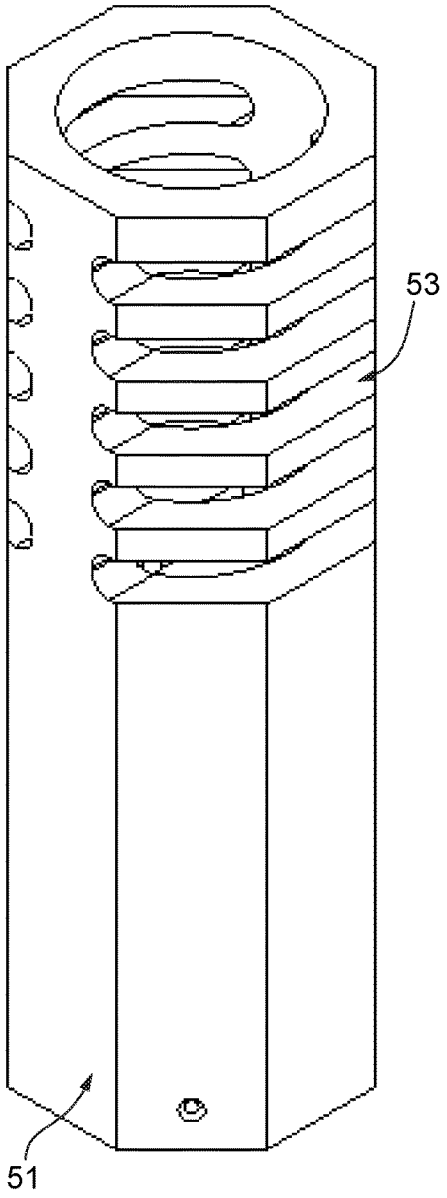
FIG. 8A and FIG. 8B are views of alternative housing bodies of the invention.
Figure 8B:
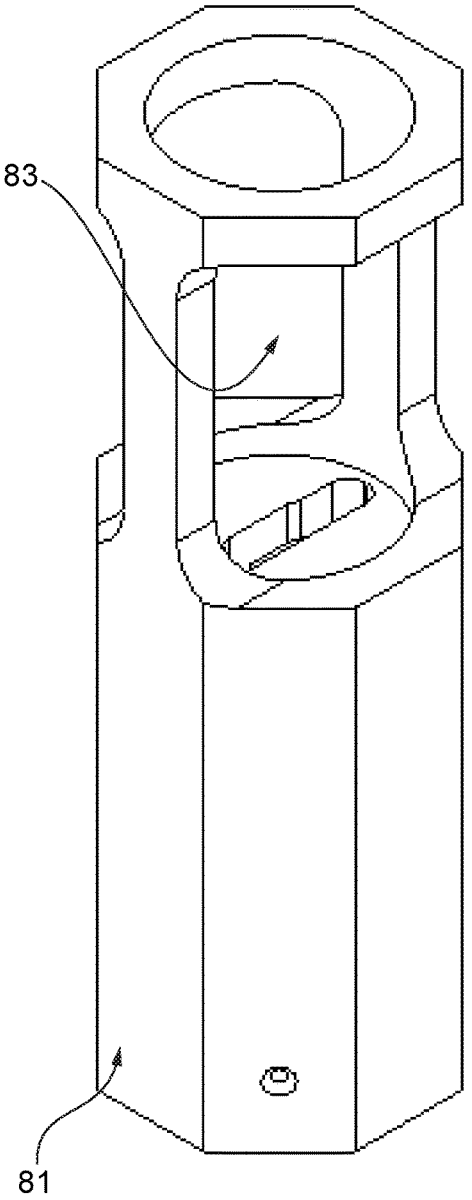

FIG. 8A and FIG. 8B are views of alternative housing bodies of the invention. While both are octagonal, the left figure depicts a housing with multiple fenestrations; the right figure depicts a housing with a single large window. The microphone in its current development is a bidirectional microphone. It has a very strong tendency to reject sounds from the sides and above.

Assembly methods are described pictorially in FIG. 9. Of interest is the role of the vertical rails forming the side edges of the chassis. These enable installation of the ribbon transducer subassembly into the internal voidspace of the housing with controlled orientation by a sliding process under light compression. When boring out the housing, additional machining may be performed to provide matching slots to receive the chassis side rails (and hence the ribbon) in a preferred orientation relative to any flats or acoustic windows in the body.

While the ribbon shown is corrugated before assembly and mounted in place using threaded fasteners, the magnets are simply inserted into corresponding top and bottom slots in the chassis and held by a combination of magnetic attraction and interference fit at the ends and further by an optional center rib or "finger" that protrudes centerwise from the ring bracket where the ribbon-magnet subassembly is mounted. The rib or finger is not necessary to fit the magnet in place, but acts as a dampening mechanism for the suspended magnet by applying slight pressure against the magnet focused at a point on the magnet that divides it into two harmonically unbalanced halves ensuring that any harmonics produced from the magnet itself will be limited by the new effective vibrating length of each side of the magnet from the rib. This is an optional feature for high SPL environments that may induce harmonic oscillation of the magnet at its resonant frequency as an independent component.

The transformer is also snug fit into its cradle in the chassis, which is then mounted by two legs on a base. An acoustic screen or mesh cup may be fitted over the transducer before the completed assembly is inserted into to the hollow housing and secured in place with a few screws or other detent mechanism. Thus the assembly process is very simple and is accomplished with fewer parts than most microphones on the market today.

INCORPORATION BY REFERENCE

All of the U.S. Patents, U.S. Patent application publications, U.S. Patent applications, foreign patents, foreign patent applications and non-patent publications referred to in this specification and related filings are incorporated herein by reference in their entirety for all purposes.

SCOPE OF THE CLAIMS

The disclosure set forth herein of certain exemplary embodiments, including all text, drawings, annotations, and graphs, is sufficient to enable one of ordinary skill in the art to practice the invention. Various alternatives, modifications and equivalents are possible, as will readily occur to those skilled in the art in practice of the invention. The inventions, examples, and embodiments described herein are not limited to particularly exemplified materials, methods, and/or structures and various changes may be made in the size, shape, type, number and arrangement of parts described herein. All embodiments, alternatives, modifications and equivalents may be combined to provide further embodiments of the present invention without departing from the true spirit and scope of the invention.

In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited in haec verba by the disclosure.

I claim:

1. An improved ribbon microphone having tonal qualities derived from a wood housing, which comprises a wood housing configured with center cavity to enclosingly receive a conductive, metallic chassis, said metallic chassis having contralateral rails for acoustically coupling to said wood housing, said wood housing having acoustic windows for receiving a sound and guide slots for receiving said lateral rails, wherein said metallic chassis is configured to support (a) a ribbon-magnet transducer combination in a cradle between said lateral rails, wherein said transducer is defined by a conductive ribbon suspended in a magnetic field having parallel flux lines between two permanent magnets such that an electrical potential is generated by sound-driven oscillation of said conductive ribbon, and (b) an electrical transformer mounted between said lateral rails, wherein said transformer is configured to receive said potential from said transducer through said chassis and to convey said potential to an amplifier; and, further characterized by a low impedance housing acoustically coupled by said lateral rails to a high impedance metal chassis, said housing having a mass that is similar to or greater than the mass of said chassis.

2. The improved ribbon microphone of claim 1, wherein said lateral rails extend from a base of the housing to a top of said acoustic windows in said guide slots, said glide slots and lateral rails having a compression fit effective in acoustically coupling said housing to said chassis.

3. The improved ribbon microphone of claim 2, wherein said magnets are precision mounted in slots in said chassis, requiring no additional fixtures or adhesive.

4. The improved ribbon microphone of claim 1, wherein said wood housing is composed of a wood body, a wood laminate body, or a composite body, and said wood of said housing is selected from ash, birch, basswood, hickory, ebony, lignum vitae, walnut, rosewood, koa, spruce, mahogany, or other woods and wood laminates effective in imparting an overtone or color to the microphone output.

5. The improved ribbon microphone of claim 4, wherein said wood body is oriented with transverse isotropy, having a grain orientation essentially normal to a ribbon of said ribbon-magnet transducer combination.

6. An improved ribbon microphone, which comprises a conductive ribbon having two ends, lateral edges, a front face and a back face, a length and a thickness supported in a magnetic field by a hoop chassis; a housing body with hollow center cavity and acoustic windows open thereto, said cavity for receiving said hoop chassis in an interference fit; and, wherein said hoop chassis, said housing body and said hollow center cavity define an acoustic cavity, said acoustic cavity having an impedance mismatch between a higher impedance of said chassis acoustically coupled by said chassis to a lower impedance of said housing body, said housing body having a mass that is similar to or greater than the mass of said chassis.

7. The improved ribbon microphone of claim 6, wherein said housing body of said acoustic cavity is made of a dampening material and is configured to act as an acoustic sink thereof so as to add a tonal quality characteristic of the dampening material.

8. The improved ribbon microphone of claim 7, wherein said dampening material is a wood, a composite, or a material having a lower acoustic impedance relative to said chassis.

9. The improved ribbon microphone of claim 8, wherein said wood of said housing body is selected from ash, birch, basswood, hickory, ebony, lignum vitae, walnut, rosewood, koa, spruce, mahogany, or other woods and wood laminates effective in imparting a desirable overtone or color to the microphone output.

10. The improved ribbon microphone of claim 8, wherein said dampening material comprises laminations having an oriented grain structure for defining a signature tonal quality to the microphone output.

11. The improved ribbon microphone of claim 6, wherein said chassis is selected from a steel, a plastic, or a ceramic.

12. The improved ribbon microphone of claim 11, wherein said chassis is composed of a high density material having precision machinable or formable properties.

13. The improved ribbon microphone of claim 6, wherein said chassis is a conductive or non-conductive high density material.

14. The improved ribbon microphone of claim 6, wherein said chassis comprises a ribbon-magnet transducer subassembly having a pair of magnets disposed contralaterally next to said ribbon, said pair of magnets defining lines of magnetic flux over said front and back faces of said ribbon, each magnet having two ends, a length, and a circumference, said circumference having a path length "L" from said front face of said ribbon to said back face thereof, wherein said path length "L" defines a treble roll-off frequency having a frequency greater than 12 KHz, preferably greater than 15 KHz, and more preferably greater than 17 KHz.

15. The improved ribbon microphone of claim 14, further comprising a mounting system for said magnets, wherein said ends of said magnets are mounted in slots at the top and the bottom of said center cavity, one slot proximate to each said lateral edge at each of said two ends of said ribbon; the depth of said slots and the end-to-end length of said magnets are dimensioned so that said magnets are longer than an effective ribbon length between a pair of clamps configured for securing said ribbon in said transducer subassembly; thereby exposing said ribbon to a magnetic field having essentially parallel lines of magnetic flux over said effective ribbon length thereof, said magnetic field having a strength equal to or greater than 42 MOSe.

16. The improved ribbon microphone of claim 15, wherein said lines of magnetic flux are not modified by a pole piece.

17. The improved ribbon microphone of claim 14, wherein said magnets are precision mounted in top and bottom slots in said chassis, requiring no additional fixtures or adhesive, and said magnets have a length greater than the effective ribbon length.

18. The improved ribbon microphone of claim 6, wherein said hoop chassis comprises contralateral guide rails, and said contralateral guide rails of said chassis are configured to be slideably received in internal mating contralateral guide slots inside said cavity of said housing, and, wherein said guide rails are in a compression fit in said guide slots so as to be effective in acoustically coupling said housing to said chassis.

19. The improved ribbon microphone of claim 6, wherein said ribbon is tensioned in clamps affixed to said chassis.

20. The improved ribbon microphone of claim 6, comprising a transformer having a primary coil with electrical connections for closing a circuit path through said ribbon and a secondary coil having an electrical output, said transformer having a seat in said chassis proximate to said ribbon.

21. The improved ribbon microphone of claim 6, wherein said housing comprises a guide sound flat externally disposed parallel to and co-axial with a front face of said ribbon, thereby directionally demarcating the orientation of the ribbon inside the housing.

22. The improved ribbon microphone of claim 6, wherein said housing comprises a multihedral array of external sound flats disposed externally thereon, said array having a guide sound flat configured to be parallel to and co-axial with a front face of said ribbon, thereby directionally demarcating the orientation of the ribbon inside the housing.

23. An improved ribbon microphone, which comprises a housing, a chassis in said housing, a conductive ribbon having two ends, lateral edges, a front face and a back face, a length and a thickness;

a) wherein said ribbon is supported in a magnetic field by said chassis and is affixed at said two ends by clamps thereto, said distance between said clamps defining an effective ribbon length;

b) wherein said chassis comprises:

a ribbon-magnet transducer subassembly having a mounting system for mounting a pair of magnets contralaterally beside said ribbon, said pair of magnets defining lines of magnetic flux across said ribbon, each magnet having two ends, a length, inside and outside magnetic faces, said outside magnetic faces defining an air gap on either side thereof, and a circumference, said circumference having a path length "L" through said air gaps from said front face to said back face of said ribbon; and, c) wherein said mounting system comprises:

mounting slots in the top and the bottom of said chassis for receiving said ends of said magnets without any fasteners or adhesives, one slot proximate to each said lateral edge at both of said two ends of said ribbon.

24. The improved ribbon microphone of claim 23, wherein the depth of said slots and the end-to-end length of said magnets are dimensioned so that said magnets are longer than said effective ribbon length when mounted in the transducer subassembly; thereby exposing said ribbon therebetween to a magnetic field having essentially parallel lines of magnetic flux over said effective ribbon length thereof.

25. The improved ribbon microphone of claim 24, wherein said magnetic field is configured with a strength equal to or greater than 42 MOSe and said path length "L" is configured so as to define a treble roll-off frequency having a frequency greater than 12 KHz, preferably greater than 15 KHz, and more preferably greater than 17 KHz.

26. The improved ribbon microphone of claim 23, wherein said chassis is a hoop chassis having contralateral guide rails, and said contralateral guide rails of said chassis are configured to be slideably received into internal mating contralateral guide slots inside a cavity of said housing.

27. The improved ribbon microphone of claim 26, wherein said guide rails are in a compression fit in said guide slots so as to be effective in acoustically coupling said chassis to said housing.

28. The improved ribbon microphone of claim 26, wherein said chassis is electrically conductive and said transformer coil is electrically connected to said conductive ribbon through said chassis.

29. The improved ribbon microphone of claim 26, wherein said magnets are dampened by a finger tab extending from said chassis to said magnet at about a middle of said magnet.

30. The improved ribbon microphone of claim 23, wherein said chassis comprises a seat adapted to mount a transformer coil, said transformer coil having operative electrical connections with said conductive ribbon through said clamps, said chassis, or a combination thereof.

* * * * *